US005603675A

United States Patent [19]

Wu

[11] Patent Number: 5,603,675

[45] Date of Patent: Feb. 18, 1997

[54] FOLDABLE STRIDING EXERCISER

[76] Inventor: Tien L. Wu, No. 34-8, Lane 2, Yu Der Road, North Dist., Taichung, Taiwan

[21] Appl. No.: 656,686

[22] Filed: May 31, 1996

[51] Int. Cl.[6] ..... A63B 22/00

[52] U.S. Cl. ..... 482/52; 482/51

[58] Field of Search ..... 482/51, 52, 53, 482/70, 148, 57, 62; 434/255

[56] References Cited

U.S. PATENT DOCUMENTS

| | | | |
|---|---|---|---|
| 4,563,001 | 1/1986 | Terauds | 482/53 |
| 4,850,585 | 7/1989 | Dalebout et al. | 482/51 |
| 4,861,023 | 8/1989 | Wedman | 482/51 |
| 4,940,233 | 7/1990 | Bull et al. | 482/51 |
| 5,000,443 | 3/1991 | Dalebout et al. | 482/51 |
| 5,039,088 | 8/1991 | Shifferaw | 482/57 |
| 5,419,747 | 5/1995 | Piaget et al. | 482/70 |

*Primary Examiner*—Stephen R. Crow
*Attorney, Agent, or Firm*—Charles E. Baxley, Esq.

[57] ABSTRACT

A striding exerciser includes a pair of posts vertically secured on a base. A frame is secured to the upper portion of the posts. A lever has a middle portion pivotally coupled to the frame at a pivot shaft. A pair of beams each has an upper portion pivotally coupled to the posts. A pair of links pivotally couples the ends of the lever to the beams. A pair of discs are secured to the lever and the frame. A brake shoe is disposed between the discs. A bolt is threadedly engaged with the discs and the brake shoe for adjusting the frictional force to the lever.

2 Claims, 3 Drawing Sheets

FOLDABLE STRIDING EXERCISER

BACKGROUND OF THE INVENTION

1. Field of the Invention

The present invention relates to a striding exerciser that may be folded to a compact configuration.

2. Description of the Prior Art

Several typical striding exercisers have been developed for simulating walking exercises. However, most of the typical striding exercisers comprise a complicated configuration that occupies a huge volume and that may not be easily manufactured. In addition, the striding exercises may not be folded to a compact configuration.

The present invention has arisen to provide a striding exercisers that may be folded.

SUMMARY OF THE INVENTION

The primary objective of the present invention is to provide a striding exerciser which may be folded to a compact configuration.

In accordance with one aspect of the invention, there is provided a striding exerciser comprising a base, a pair of posts each including a lower portion pivotally coupled to the base at a first pivot shaft so as to allow the posts to be folded relative to the base about the first pivot shaft, the posts each including an upper portion, a pair of bars each including a first end secured to the posts and each includes a second end secured to the base by a first fastening member so as to support the posts in a vertical position relative to the base and so as to allow the posts to be folded relative to the base about the first pivot shaft when the first fastening member is disengaged from the base, a frame secured to the upper portion of the posts by a second fastening member and maintained in a perpendicular position relative to the posts by the second fastening member, the frame being allowed to be folded toward the posts when the second fastening member is disengaged from the frame and the posts, the frame including a middle portion, a lever including a middle portion pivotally coupled to the middle portion of the frame at a second pivot shaft so as to allow the lever to be rotated about the second pivot shaft, the lever including two end portions, a pair of beams each including an upper portion pivotally coupled to the upper ends of the posts by a third pivot shaft and each including a bottom portion having a foot support provided thereon for supporting a foot of a user, a pair of handles each including a lower end secured to the upper portions of the beams, and a pair of links each including a first end pivotally coupled to the end portions of the lever at a first pivot pin and each including a second end pivotally coupled to the beams by a third fastening member so as to allow the lever to be rotated about the second pivot shaft by the beams when the beams are rotated about the third pivot shafts in a reciprocating action by the user, the links being allowed to be folded to engage with the lever when the third fastening members are disengaged from the beams.

A first disc is secured to the middle portion of the lever, a second disc is secured to the middle portion of the frame, and a brake shoe is engaged between the first and the discs, the second pivot shaft is a bolt and threadedly engaged through the first and the second discs and the brake shoe for securing the lever to the frame.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 3:
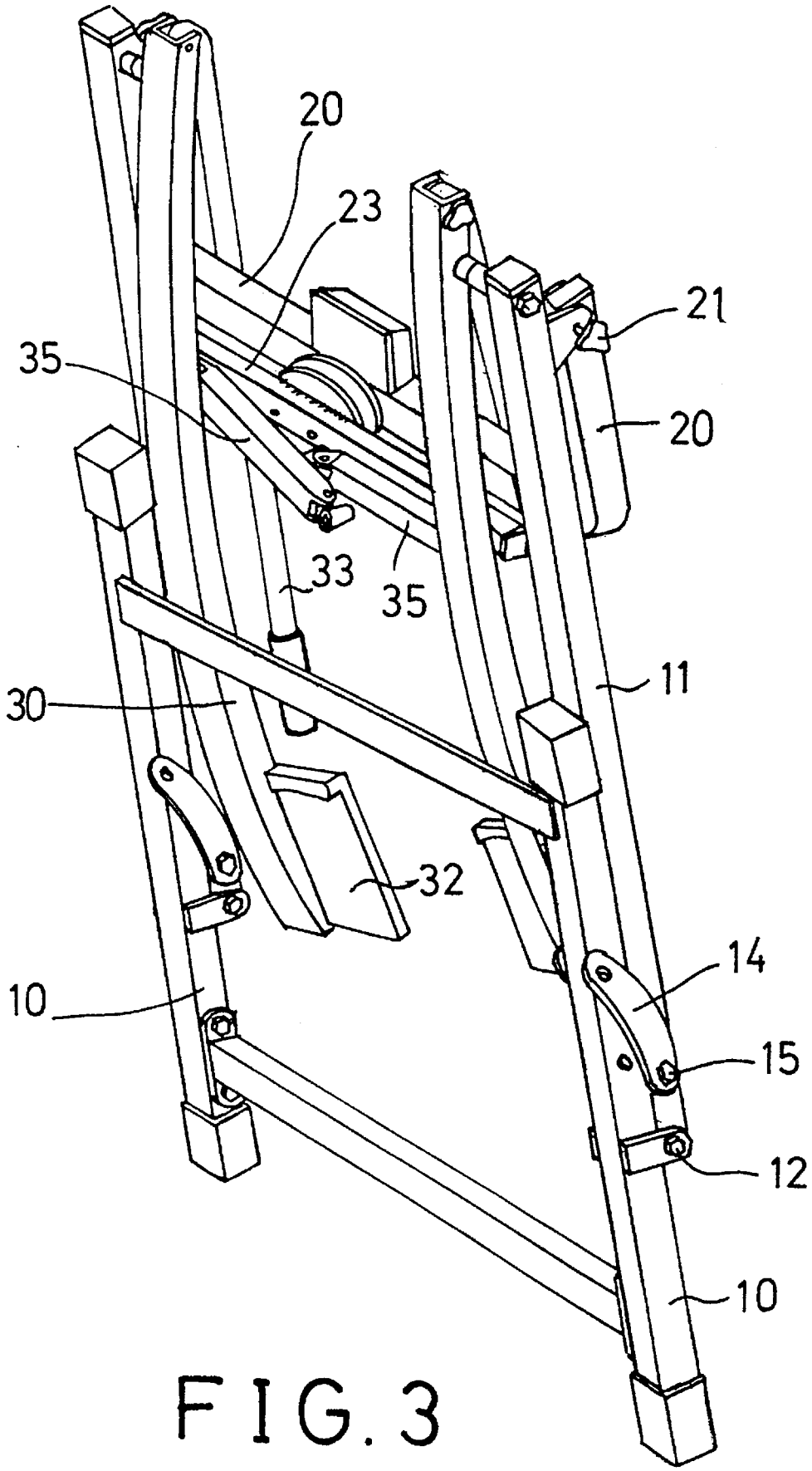
FIG. 3 is a perspective view illustrating the folding configuration of the striding exerciser.

Referring to the drawings, a foldable striding exerciser in accordance with the present invention comprises a base 10. A pair of posts 11 each has a lower portion pivotally coupled to the base 10 by screws 12. One or two pairs of bars 14 each has one end secured to the posts 11 by screws 15 and each has the other end secured to the base 10 by screws 16 such that the posts 11 can be supported in a vertical position relative to the base 10, best shown in FIG. 1. The posts 11 may be folded relative to the base 10 about the bolts 12 (FIG. 3) When the bolts 16 are disengaged from the base 10.

A U-shaped frame 20 is secured to the upper portion of the posts 11 by bolts 21 and is maintained in a perpendicular position relative to the posts 11 by the bolts 21. The frame 20 may be folded toward the posts 11 when the bolts 21 are disengaged from the frame 20 and the posts 11. A meter 22 is provided on the frame 20. A lever 23 includes a disc 24 secured to the middle portion thereof. Another disc 25 is secured to the middle and bottom portion of the frame 20. A brake shoe 26 is engaged between the discs 24, 25. A bolt 27 is threadedly engaged through the discs 24, 25 and the brake shoe 26 for securing the lever 23 to the frame 20. When the lever 23 is tightly secured to the frame 20 by the bolt 27, the brake shoe 26 may apply a great frictional force to the discs 24, 25 such that the lever 23 can not be easily rotated about the bolt 27. The lever 23 can be freely rotated about the bolt 27 when the lever 23 is not tightly secured to the frame 20 by the bolt 27.

A pair of beams 30 each includes an upper portion pivotally coupled to the upper ends of the respective posts 11 by pivot shafts 31 and each includes a foot support 32 provided in the bottom port ion for supporting the feet Of the user. A pair of handles 33 each has a lower end secured to the upper ends of the respective beams 30 by bolts 34, 38. The handles 33 are rotatable about the bolts 34 to engage with the beams 30 (FIG. 3) when the bolts 38 are disengaged from the handles 33. A pair of links 35 each has one end pivotally coupled to the respective end portion of the lever 23 by pivot pin 36 and each has the other end pivotally coupled to the beams 30 by pivot pins 37, such that the lever 23 can be rotated about the bolt 27 by the beams 30 when the beams 30 are rotated about the pivot shafts 31 in a reciprocating action by the user. The links 35 may be folded to engage with the lever 23 (FIG. 3) when the bolts 37 are disengaged from the beams 30.

Figure 1:
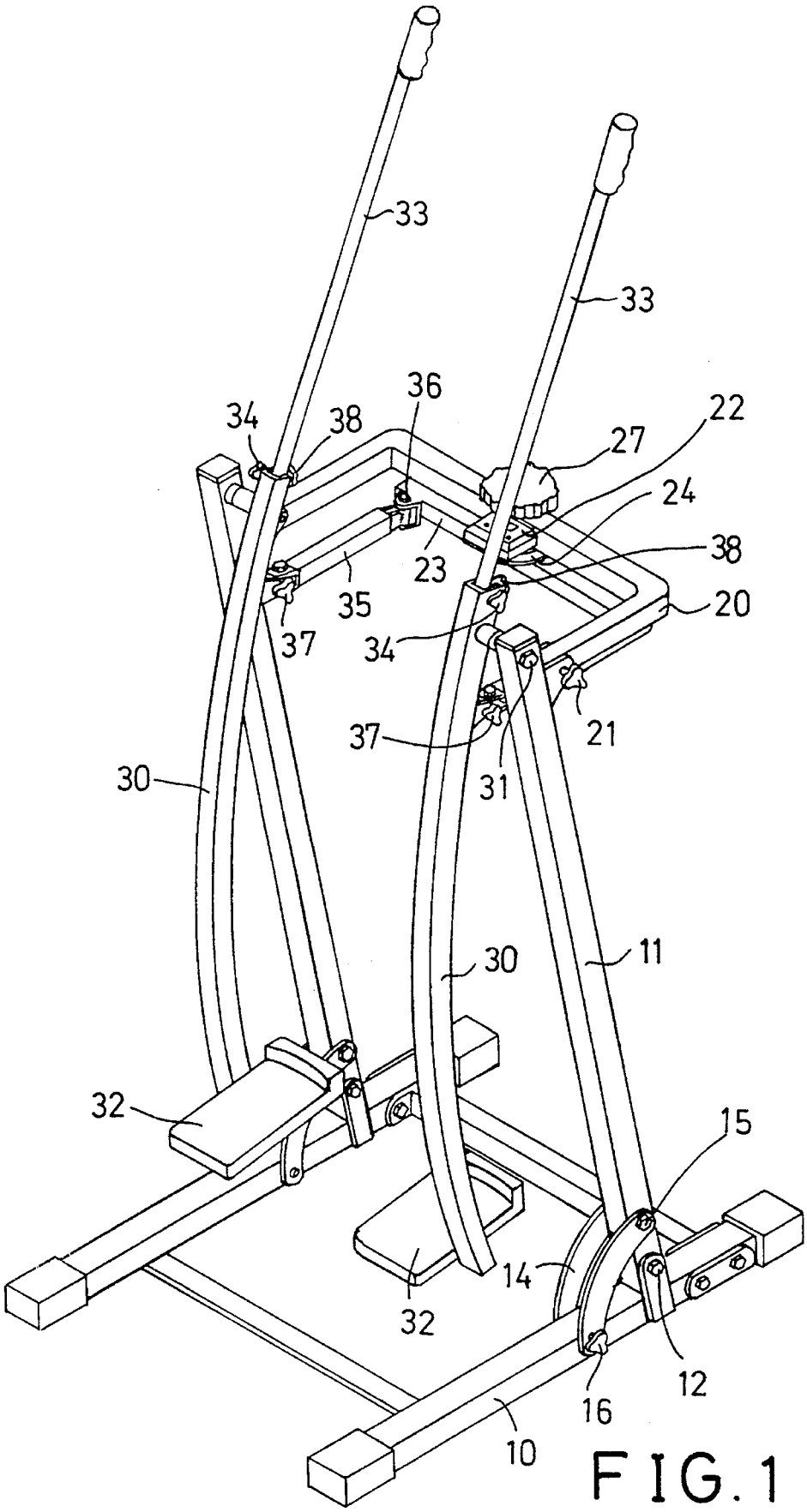
FIG. 1 is a perspective view of a foldable striding exerciser in accordance with the present invention.
Figure 2:
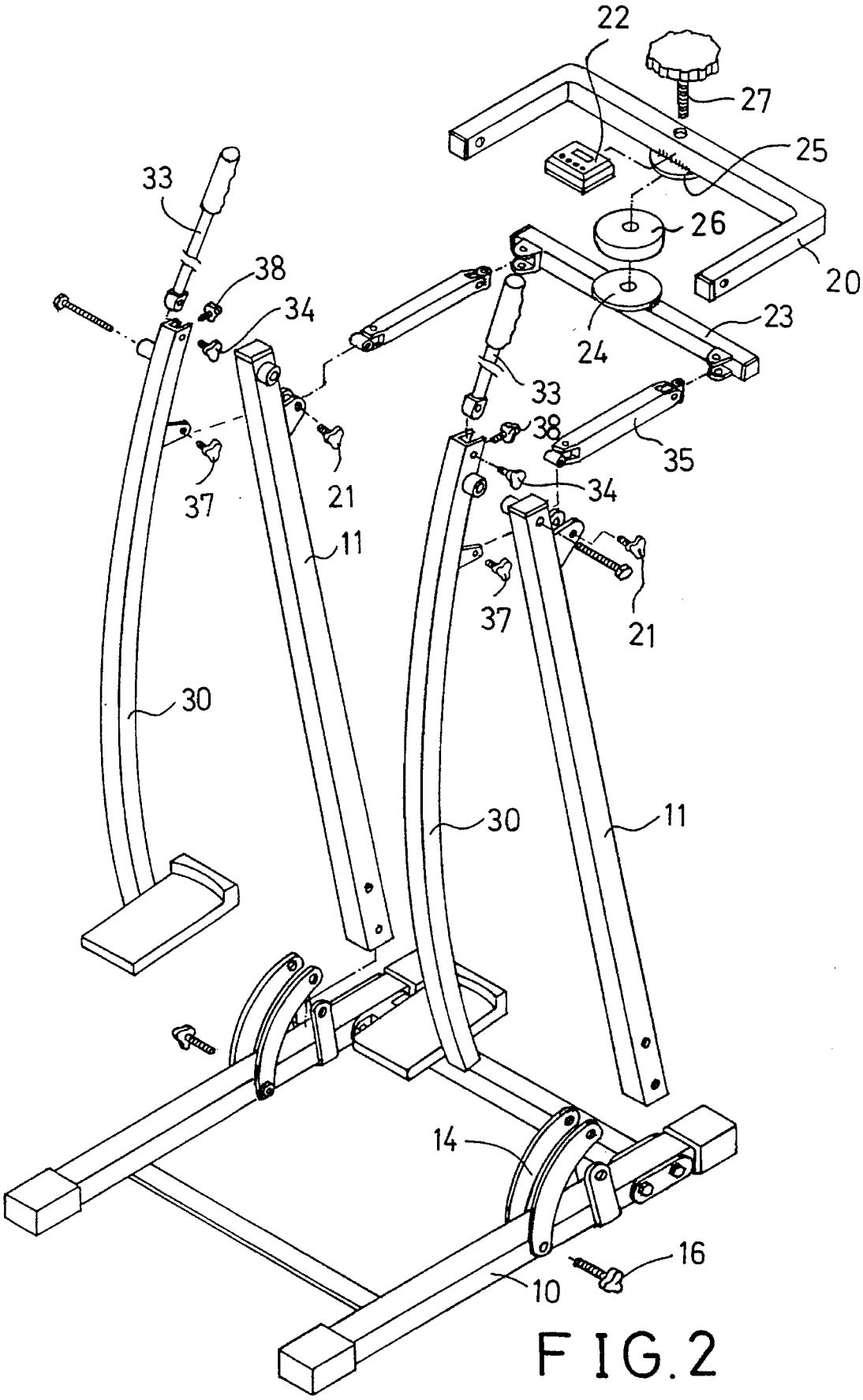
FIG. 2 is an exploded view of the foldable striding exerciser.

In operation, as shown in FIG. 1, the lever 23 can be caused to rotated about the bolt 27 by the beams 30 when the beams 30 are rotated about the pivot shafts 31 in a reciprocating action by the user such that the user may simulate walking exercise. The bolt 27 may adjust the frictional force applied to the lever 23 by the brake shoe 26, according to the user's strength.

Accordingly, the striding exerciser in accordance with the present invention includes a configuration that can be folded to a compact configuration that is excellent for storing and for transportation purposes. In addition, the frictional force applied to the beams and the handles can be adjusted according to different user's need.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A striding exerciser comprising:

a base, a pair of posts each including a lower portion pivotally coupled to said base at a first pivot shaft so as to allow said posts to be folded relative to said base about said first pivot shaft, said posts each including an upper portion, a pair of bars each including a first end secured to said posts and each includes a second end secured to said base by a first fastening member so as to support said posts in a vertical position relative to said base and so as to allow said posts to be folded relative to said base about said first pivot shaft when said first fastening member is disengaged from said base, a frame secured to said upper portion of said posts by a second fastening member and maintained in a perpendicular positions relative to said posts by said second fastening member, said frame being allowed to be folded toward said posts when said second fastening member is disengaged from said frame and said posts, said frame including a middle portion, a lever including a middle portion pivotally coupled to said middle portion of said frame at a second pivot shaft so as to allow said lever to be rotated about said second pivot shaft, said lever including two end portions, a pair of beams each including an upper portion pivotally coupled to said upper ends of said posts by a third pivot shaft and each including a bottom portion having a foot support provided thereon for supporting a foot of a user, a pair of handles each including a lower end secured to said upper portions of said beams, and a pair of links each including a first end pivotally coupled to said end portions of said lever at a first pivot pin and each including a second end pivotally coupled to said beams by a third fastening member so as to allow said lever to be rotated about said second pivot shaft by said beams when said beams are rotated about said third pivot shafts in a reciprocating action by the user, said links being allowed to be folded to engage with said lever when said third fastening members are disengaged from said beams.

2. A striding exerciser according to claim 1 further comprising a first disc secured to said middle portion of said lever, a second disc secured to said middle portion of said frame, and a brake shoe engaged between said first and said discs, said second pivot shaft being a bolt and threadedly engaged through said first and said second discs and said brake shoe for securing said lever to said frame.

* * * * *